US006809625B2

(12) United States Patent
Rinaldi et al.

(10) Patent No.: US 6,809,625 B2
(45) Date of Patent: Oct. 26, 2004

(54) INTEGRATED CONNECTOR AND POSITIVE THERMAL COEFFICIENT SWITCH

(75) Inventors: Jarett Rinaldi, Beaverton, OR (US); Patrick D. Boyd, Aloha, OR (US); Al LaValle, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/022,369

(22) Filed: Dec. 20, 2001

(65) Prior Publication Data

US 2003/0117253 A1 Jun. 26, 2003

(51) Int. Cl.[7] ..... H01H 85/46; H01H 85/44

(52) U.S. Cl. ..... 337/167; 337/188; 337/297; 439/621; 439/622

(58) Field of Search ..... 337/167, 186, 337/187, 188, 227, 229, 297; 439/250, 366, 621, 622, 890, 893; 257/665

(56) References Cited

U.S. PATENT DOCUMENTS 3,648,116 A * 3/1972 Teagno ..... 337/211
3,877,770 A * 4/1975 Saunders et al. ..... 439/495
4,199,214 A * 4/1980 Pearce et al. ..... 439/621
4,218,109 A * 8/1980 Kneusels ..... 439/621
4,280,748 A * 7/1981 McHenney et al. ..... 439/621
4,950,169 A * 8/1990 Martin et al. ..... 439/44
5,668,698 A * 9/1997 Jozwiak et al. ..... 361/752
5,775,940 A * 7/1998 Tanigawa ..... 439/507
5,805,047 A * 9/1998 De Villeroche et al. .... 337/290
5,980,322 A * 11/1999 Madsen et al. ..... 439/621
5,990,779 A * 11/1999 Katsuki et al. ..... 338/232
5,993,260 A * 11/1999 Lindquist ..... 439/621
6,109,973 A * 8/2000 Gronowicz et al. ..... 439/620
6,146,206 A * 11/2000 Konno et al. ..... 439/621
6,210,232 B1 * 4/2001 Lai et al. ..... 439/620
6,239,977 B1 * 5/2001 Price et al. ..... 361/737
6,305,987 B1 * 10/2001 Crane et al. ..... 439/676
6,492,894 B2 * 12/2002 Bone et al. ..... 337/32
2003/0013344 A1 * 1/2003 Harris ..... 439/620

FOREIGN PATENT DOCUMENTS

DE 3414907 A1 * 10/1985 ..... H02G/3/08
DE 4015816 A1 * 11/1991 ..... H01C/7/13

OTHER PUBLICATIONS

WEBSTER'S New Riverside University Dictionary, copy of p. 1070, 1071 (fragments).*

* cited by examiner

*Primary Examiner*—Anatoly Vortman
(74) *Attorney, Agent, or Firm*—Schwegman, Lundberg, Woessner & Kluth, P.A.

(57) ABSTRACT

A connector to supply power or communications to a printed circuit board having positive thermal coefficient switches embedded in or mounted on the connector. These positive thermal coefficient switches are linked to connector leads that in turn are connected to leads/traces embedded in or on the printed circuit board. The connector using these positive thermal coefficient switches protects the circuitry of the printed circuit board from possible damage.

13 Claims, 7 Drawing Sheets

INTEGRATED CONNECTOR AND POSITIVE THERMAL COEFFICIENT SWITCH

FIELD

The invention relates to an integrated connector and positive thermal coefficient switch. More particularly, the present invention is a connector that is used to communicate with or supply power to a printed circuit board in which the connector has a positive thermal coefficient switch contained therein.

BACKGROUND

In the rapid development of computers many advancements have been seen in the areas of processor speed, throughput, communications, and fault tolerance. Today an entire computer can fit into the palm of a hand that are known as palm computers and personal digital assistants do. In a larger cabinet peripherals may also be included in the computer system that once filled entire rooms. However, regardless of size of the cabinet or the usage a printed circuit board serves, space is always at a premium on a printed circuit board. This would particularly be the case for a baseboard (motherboard) in which a microprocessor, memory, communications interface, and peripheral interfaces are attached thereto. However, it would also be the case for the peripheral and communication's interfaces that would often be placed on separate boards. Further, the printed circuit board serves the primary function of establishing communications between chips placed on the printed circuit board and possibly other boards. Therefore, a paramount concern in printed circuit board design is the communications and power lines and their layout on the surface of the printed circuit board or in the embedded layers of the printed circuit board and communications between one layer and another in the printed circuit board.

FIG. 1A is an example of a side view of a printed circuit board (PCB) 10 having a connector 30 and surface mounted positive thermal coefficient switches 20 contained therein. The positive thermal coefficient switch 20 is required to cut off power or communications in a connector lead (not shown) when the amount of current passing through the connector lead exceeds the thermal coefficient of the positive thermal coefficient switch 20. These positive thermal coefficient switches 20 are required in an order to protect the circuitry on the printed circuit board 10.

FIG. 1B is an example of a side view of a printed circuit board 10 having a through hole mount (THM) embedded positive thermal coefficient switch 20. FIG. 1B is similar to FIG. 1A with the exception that FIG. 1B has the positive thermal crustaceans switch 20 through the printed circuit boad 10. Therefore, no further discussion of FIG. 1B will be provided here.

FIG. 2 is an example of a top view of a printed circuit board 10 having a through hole or surface mounted positive thermal coefficient switches 20. In this figure several leads/traces 40 are connected to the connector 30 and are either through the printed circuit board 10 or on the surface thereof. Attached to the numerous leads/traces 40 are positive thermal coefficient switches 20 which are either through or surface mounted. As indicated in the figure, not all leads/traces 40 have a positive thermal coefficient switch 20 attached thereto. However, each positive thermal coefficient switch 20 takes up space either in or on the printed circuit board 10 and further obstructs the close placement of lead/traces 40.

FIG. 3 is an example of a top view of a printed circuit board 10 having an embedded or surface mounted positive thermal coefficient switches 20. FIG. 3 is similar to FIG. 2, with the exception that three leads/traces 40 interconnect prior to entering connector 30. It should further be noted that in spite of a common connection each individual lead/traces 40 is required to have its own positive thermal coefficient switch 20. This adds to the space required for positive thermal coefficient switches 20 on the printed circuit board 10 and also limits the number of lead/traces 40 which can be placed adjacent to each other on the printed circuit board 10.

Therefore, what is required is a device that will eliminate the need to for positive thermal coefficient switches being placed on the surface of or through a printed circuit board. This device should free up space on the printed circuit board and enable a higher concentration of leads/traces being placed on an embedded printed circuit board.

BRIEF DESCRIPTION OF THE DRAWINGS

The foregoing and a better understanding of the present invention will become apparent from the following detailed description of exemplary embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and the invention is not limited thereto. The spirit and scope of the present invention are limited only by the terms of the appended claims.

The following represents brief descriptions of the drawings, wherein.

DETAILED DESCRIPTION

Figure 1A:
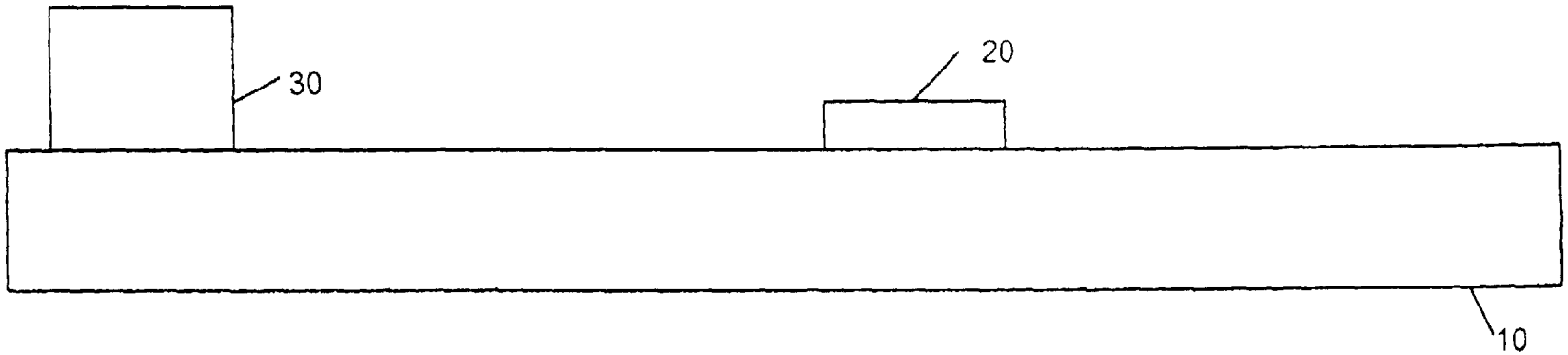
FIG. 1A (PRIOR ART)
FIG. 1A is an example of a side view of a printed circuit board (PCB) having a surface mounted positive thermal coefficient switch.
Figure 1B:
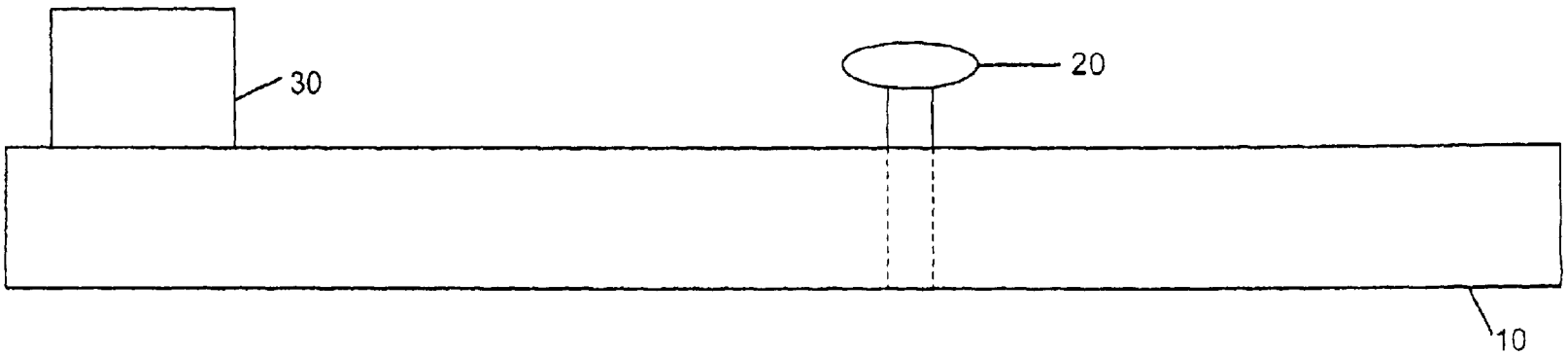
FIG. 1B (PRIOR ART)
FIG. 1B is an example of a side view of a printed circuit board having a through positive thermal coefficient switch.
Figure 2:
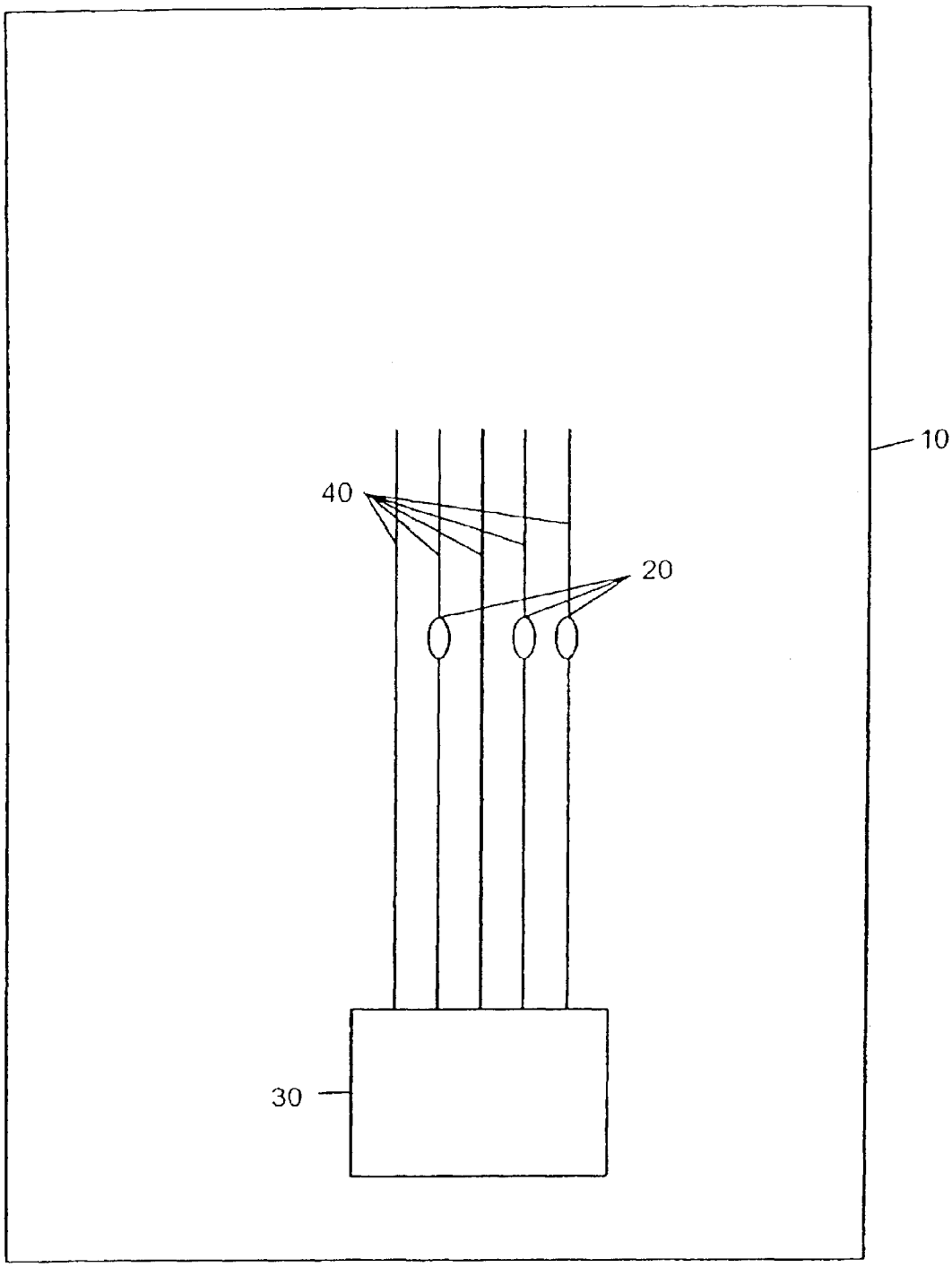
FIG. 2 (PRIOR ART)
FIG. 2 is an example of a top view of a printed circuit board having a through or surface mounted positive thermal coefficient switches.
Figure 3:
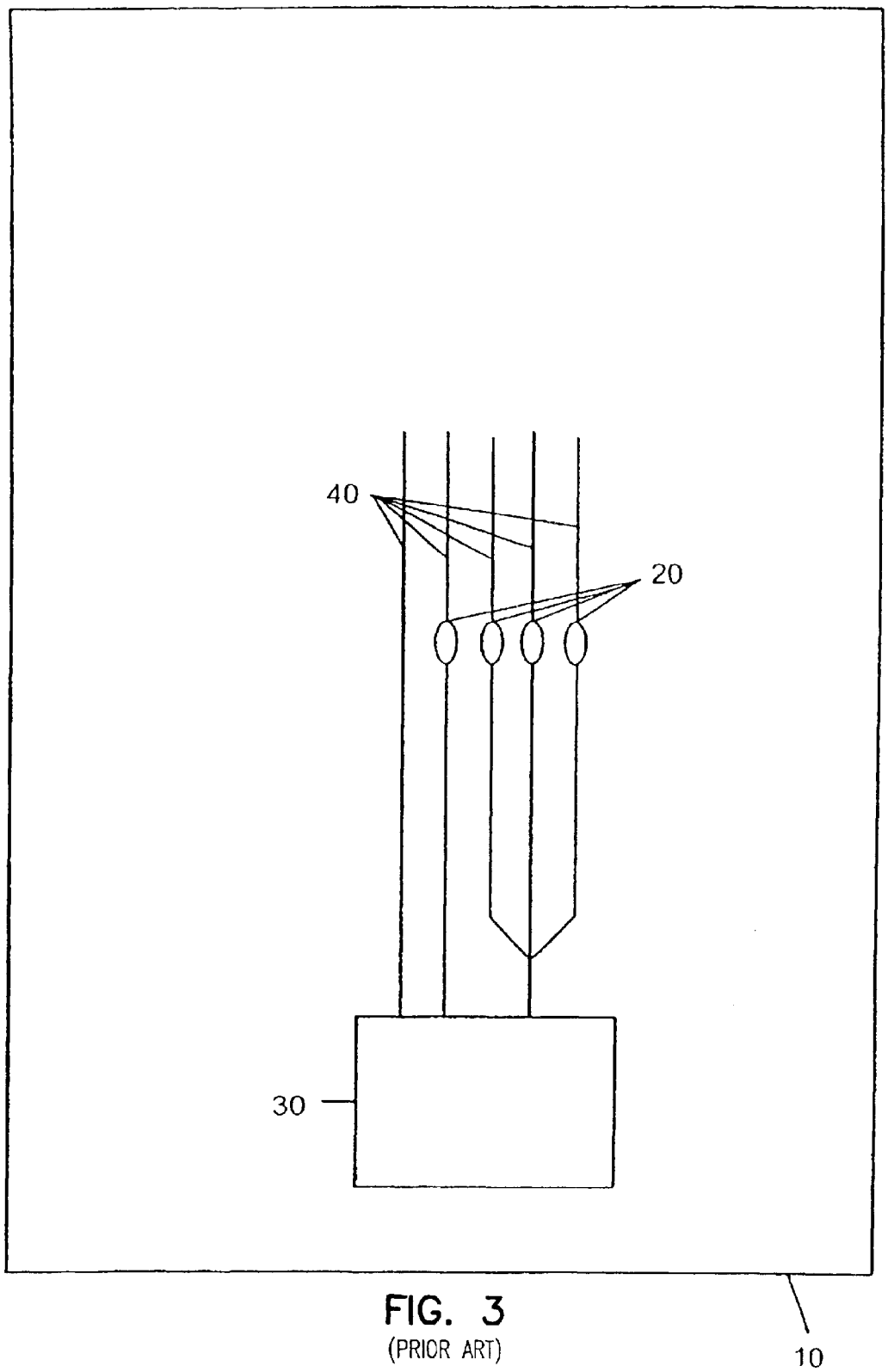
FIG. 3 (PRIOR ART)
FIG. 3 is an example of a top view of a printed circuit board having a through or surface mounted positive thermal coefficient switches.

Before beginning a detailed description of the subject invention, mention of the following is in order. When appropriate, like reference numerals and characters may be used to designate identical, corresponding or similar components in differing figure drawings. Further, in the detailed description to follow, exemplary sizes/models/values/ranges may be given, although the present invention is not limited to the same. As a final note, well-known components of computer networks may not be shown within the FIGs. for simplicity of illustration and discussion, and so as not to obscure the invention.

Figure 4A:
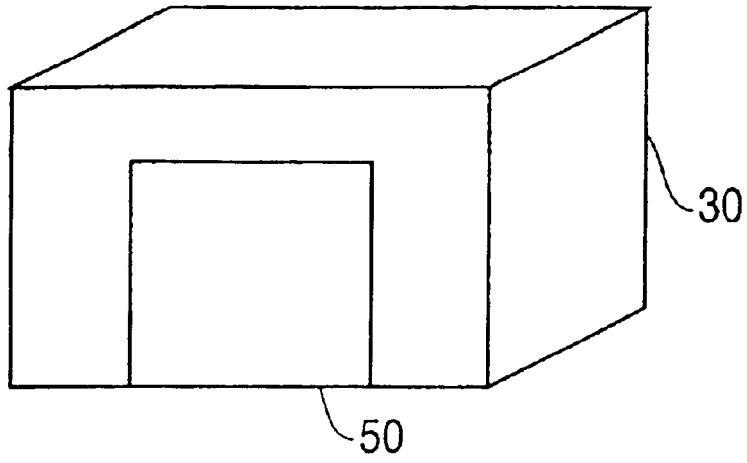
FIG. 4A is a front view of a connector in an example embodiment of the present invention.

FIG. 4A is a front view of a connector 30 in an example embodiment of the present invention. This connector 30 has a connector port 50 which may either accept power or communications with components outside a computer system or within the computer system.

Figure 4B:
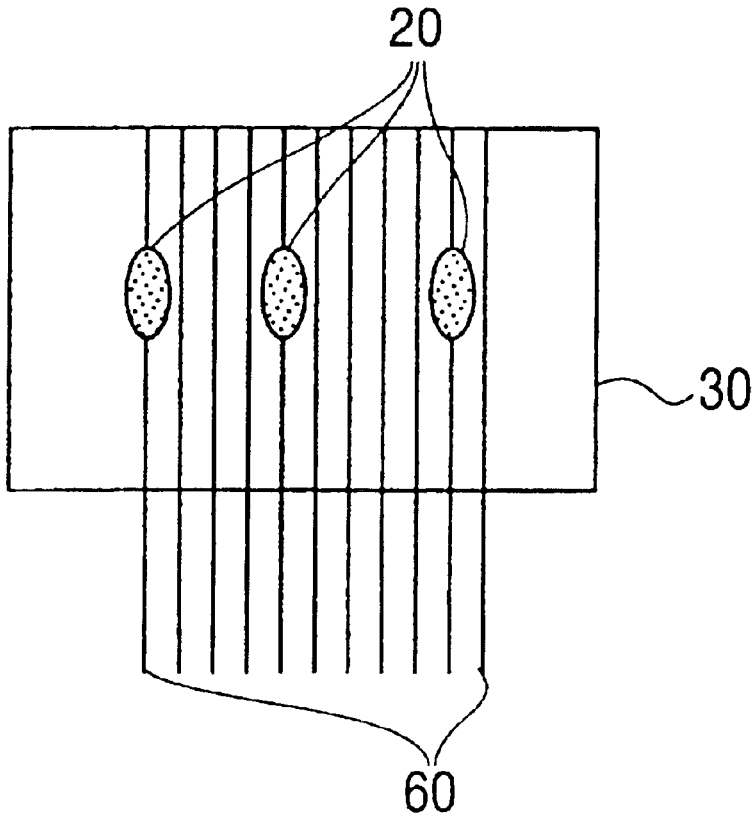
FIG. 4B is a back view of the connector shown in FIG. 4A with axial leaded positive thermal coefficient switches in an example embodiment of the present invention.

FIG. 4B is a back view of the connector 30 shown in FIG. 4A with axial leaded positive thermal coefficient switches 20 in an example embodiment of the present invention. The positive thermal coefficient switches 20 are connected to connector leads 60 that in turn would connect to leads/traces 40 (not shown) and further discussed in FIGS. 6 and 7 ahead. It should be noted that not all connector leads 60 contain positive thermal coefficient switches 20 connected thereto. Therefore, only those components on the printed circuit board 10 which require the protection of positive thermal coefficient switches 20 would have them placed in connector 30. Further, these positive thermal coefficient switches 20 may be, but not limited to, axial leaded positive thermal coefficient switches.

Figure 5A:
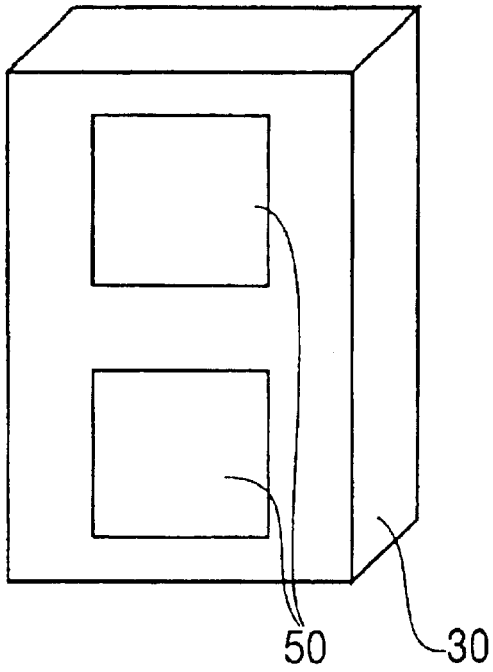
FIG. 5A is a front view of an integrated connector in an example embodiment of the present invention.

FIG. 5A is a front view of a connector 30 in an example embodiment of the present invention. In this embodiment of the present invention, two connector ports 50 are illustrated placed on top of connector 30. However, as would be appreciated by one of ordinary skill in the art, any number all the ports may be placed on any exposed surface of the connector 30 illustrated in either FIG. 4A or FIG. 5A.

Figure 5B:
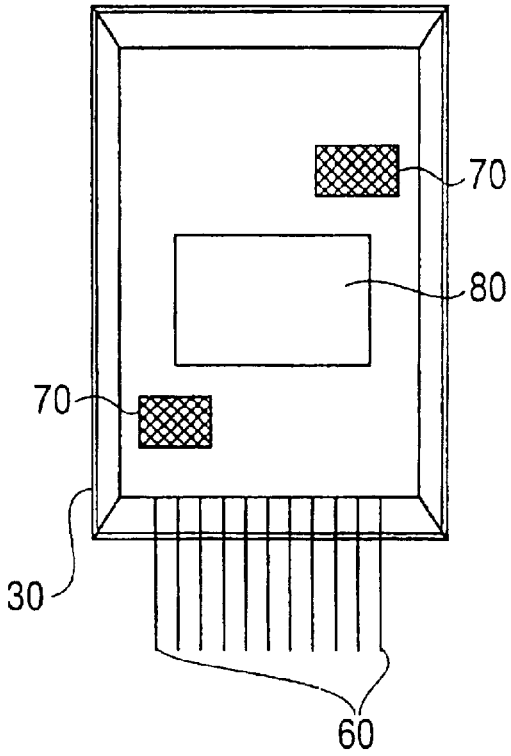
FIG. 5B is a back view of the integrated connector shown in FIG. 5A with surface mounted positive thermal coefficient switches in an example embodiment of the present invention.

FIG. 5B is a back view of the connector 30 shown in FIG. 5A with surface mounted positive thermal coefficient switches 70 in an example embodiment of the present invention. The surface mounted positive thermal coefficient switches 70 are connected to connector leads 60 and other magnetic components 80 within connector 30. It should be noted that the surface mounted positive thermal coefficient switches 70 may be placed on any exposed surface of connector 30 where space permits. Further, the surface mounted positive thermal coefficient switches 70 would be connected to connector leads 60 as required and would not necessarily include all connector leads 60.

Figure 6:
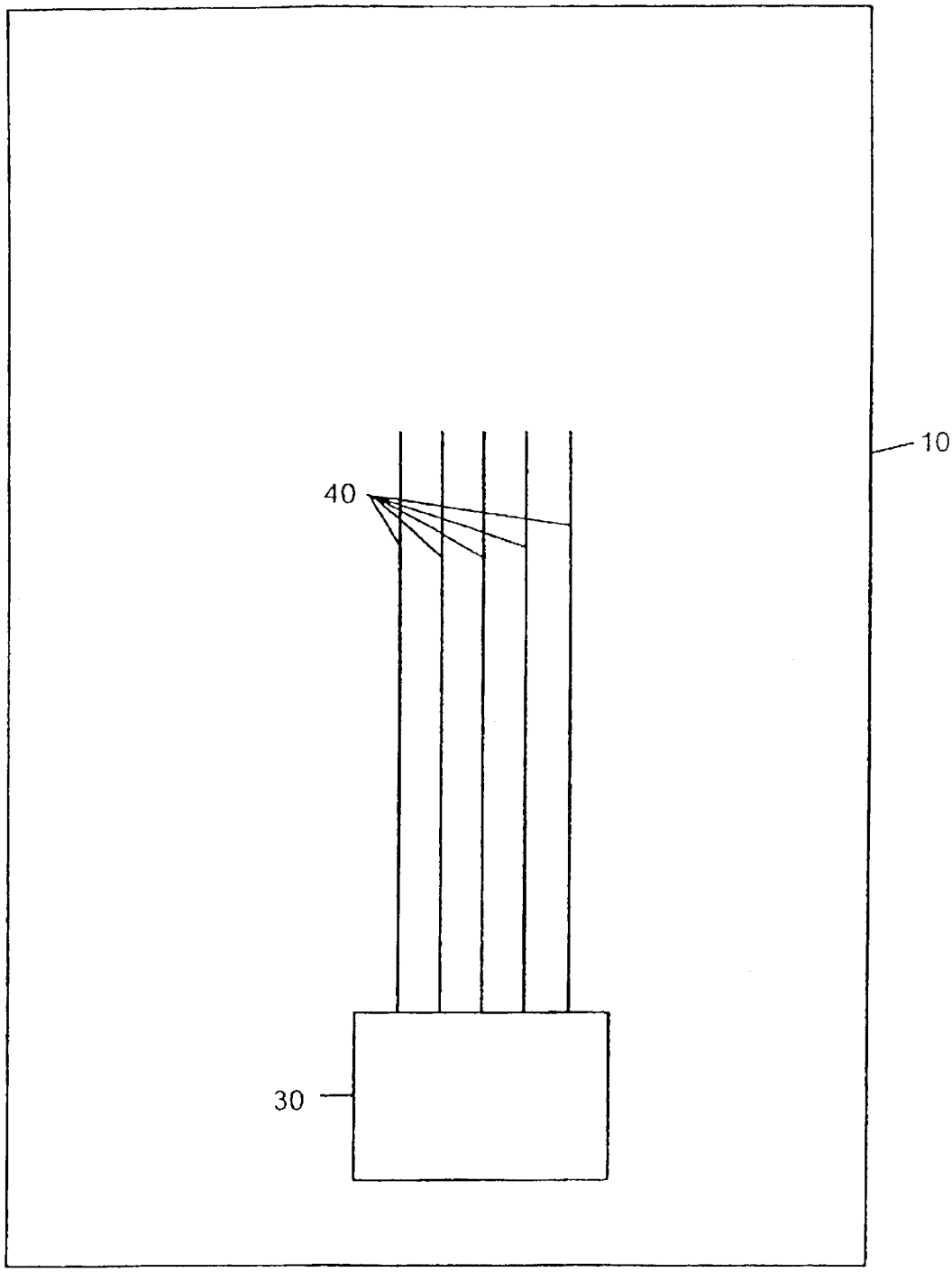
FIG. 6 is a top view of an example of a printed circuit board using the embodiments of the present shown in FIGS. 4A through 5B.

FIG. 6 is a top view of an example of a printed circuit board 10 using the embodiments of the present shown in FIGS. 4A through 5B. Utilizing the embodiments of the present invention shown in FIGS. 4A through 5B, the leads/traces 40 contained on or within printed circuit board 10 do not require the presence of positive thermal coefficient switches since these positive thermal coefficient switches would be contained in connector 30. Therefore, the leads/traces 40 maybe placed in closer proximity to one another, thereby saving space for other circuits on printed circuit board 10.

Figure 7:
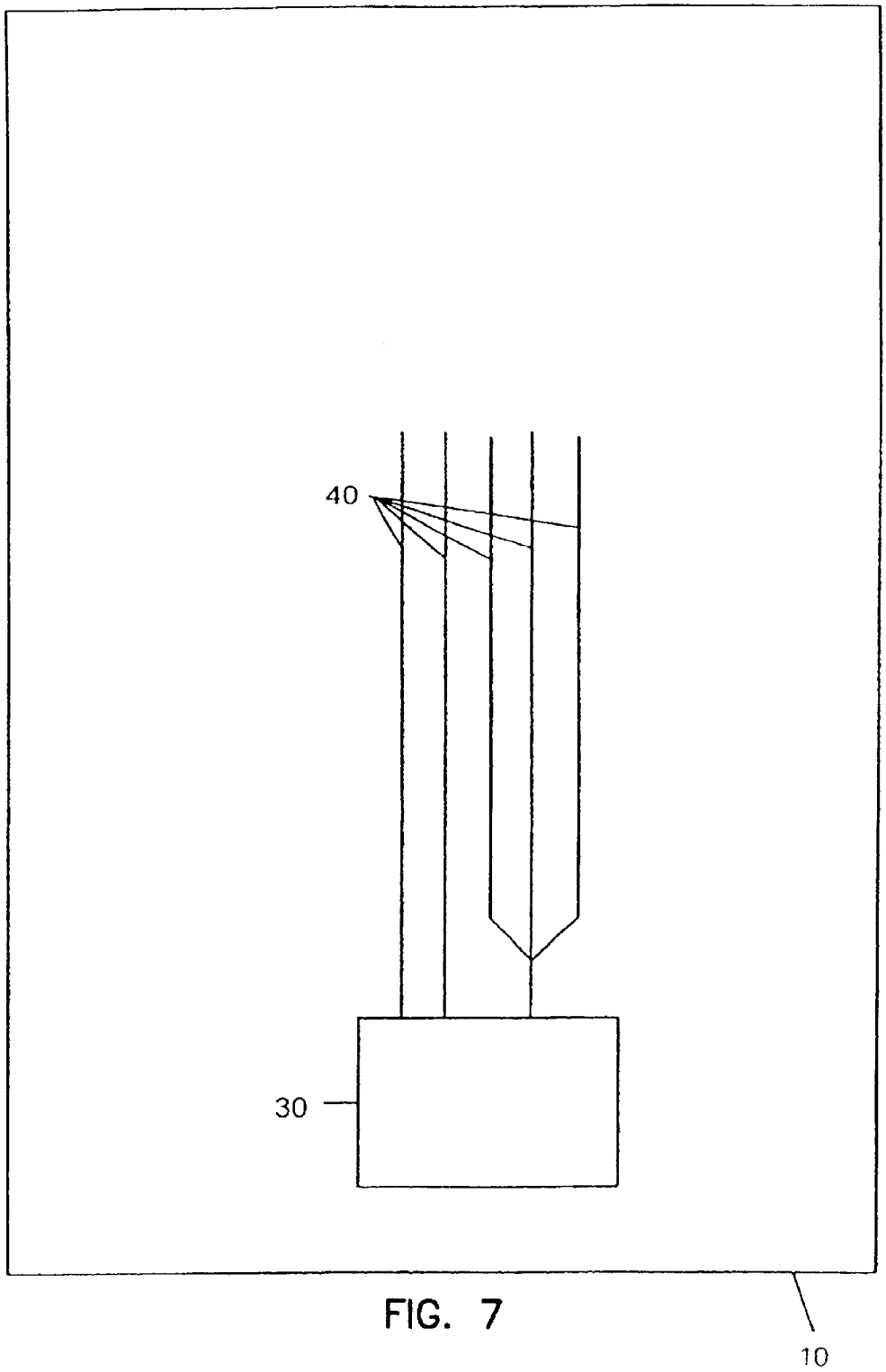
FIG. 7 is a top view of another example of a printed circuit board using the embodiments of the present shown in FIGS. 4A through 5B.

FIG. 7 is a top view of another example of a printed circuit board using the embodiments of the present invention shown in FIGS. 4A through 5B. FIG. 7 is similar to FIG. 6 with the exception that certain leads/traces 40 connect to a common connector lead contained within switch 30. Therefore, a single positive thermal coefficient switch may be placed in or surface mounted to switch 30 and support several leads/traces 40 without the need for individual leads/traces 40 on the printed circuit board. Thus by being able to support multiple leads/traces 40 with a single positive thermal coefficient switch significant savings of space and money may be realized utilizing the embodiments of the present invention.

The benefits resulting from the present invention is that a simple, device is provided for protecting circuitry within a printed circuit board while reducing the space required on the printed circuit board and reducing the cost involved in creating a printed circuit board.

While we have shown and described only a few examples herein, it is understood that numerous changes and modifications as known to those skilled in the art could be made to the example embodiment of the present invention. Therefore, we do not wish to be limited to the details shown and described herein, but intend to cover all such changes and modifications as are encompassed by the scope of the appended claims.

We claim:

1. A connector, comprising:

at least one connector port in the connector to supply power or establish communications to a printed circuit board;

at least one connector lead to connect the at least one connector port to the printed circuit board; and at least one positive thermal coefficient switch that is part of the connector on an exposed exterior surface of the connector between the at least one connector port and the at least one connector lead to cut off communications or power and protect at least one circuit in the printed circuit board.

2. The connector of claim 1, wherein the at least one positive thermal coefficient switch is an axial leaded positive thermal coefficient switch embedded within the exposed exterior surface of the connector.

3. The connector of claim 1, wherein the at least one positive thermal coefficient switch is a surface mounted positive thermal coefficient switch mounted on the exposed exterior surface of the connector.

4. The connector of claim 3, wherein the at least one connector lead connected to the at least one connector port is connected to at least one lead/trace embedded in or mounted on the printed circuit board.

5. The connector of claim 1, wherein the at least one connector lead connected to the at least one connector port is connected to at least one trace/lead embedded in or mounted on the printed circuit board.

6. A connector, comprising:

at least one connector port in the connector to supply power or establish communications to a printed circuit board;

a plurality of connector leads to connect the at least one connector port to the printed circuit board; and a plurality of positive thermal coefficient switches that are part of the connector on an exposed exterior surface of the connector between the at least one connector port and the plurality of connector leads to cut off communications or power and protect at least one circuit in the printed circuit board.

7. The connector of claim 6, wherein a single connector lead of the plurality of connector leads is connected to a positive thermal coefficient switch of the plurality of positive thermal coefficient switches and is connected to a lead/trace contained within the printed circuit board and is connected to the at least one circuit in the printed circuit board.

8. The connector of claim 7, wherein the plurality of positive thermal coefficient switches are a plurality of axial leaded positive thermal coefficient switches embedded within the exposed exterior surface of the connector.

9. The connector of claim 7, wherein the plurality of positive thermal coefficient switches are a plurality of surface mounted positive thermal coefficient switches mounted on the exposed exterior surface of the connector.

10. The connector of claim 7, wherein the at least one connector port is a plurality of connector ports.

11. A connector, comprising:

at least one connector port in the connector to supply power or establish communications to a printed circuit board;

a plurality of connector leads to connect the at least one connector port to the printed circuit board; and a plurality of positive thermal coefficient switches that are part of the connector on an exposed exterior surface of the connector between the at least one connector port and the plurality of connector leads to cut off communications or power and protect at least one circuit in the printed circuit board, wherein a single connector lead of the plurality of connector leads is connected to a positive thermal coefficient switch of the plurality of positive thermal coefficient switches and is connected to a lead/trace contained within the printed circuit board and is connected to the at least one circuit in the printed circuit board.

12. The connector of claim 11, wherein the plurality of positive thermal coefficient switches are a plurality of axial leaded positive thermal coefficient switches embedded within the exposed exterior surface of the connector.

13. The connector of claim 11, wherein the plurality of positive thermal coefficient switches are a plurality of surface mounted positive thermal coefficient switches mounted on the exposed exterior surface of the connector.

* * * * *

UNITED STATES PATENT AND TRADEMARK OFFICE

CERTIFICATE OF CORRECTION

PATENT NO. : 6,809,625 B2
DATED : October 26, 2004
INVENTOR(S) : Rinaldi et al.

It is certified that error appears in the above-identified patent and that said Letters Patent is hereby corrected as shown below:

Title page,
Item [56], References Cited, U.S. PATENT DOCUMENTS, delete "3,648,116" and insert -- 3,648,115 --, therefor.

Signed and Sealed this

Twenty-sixth Day of April, 2005

JON W. DUDAS
*Director of the United States Patent and Trademark Office*